US011221151B2

(12) United States Patent
Mohite et al.

(10) Patent No.: US 11,221,151 B2
(45) Date of Patent: Jan. 11, 2022

(54) HOT GAS REHEAT SYSTEMS AND METHODS

(71) Applicant: Johnson Controls Technology Company, Auburn Hills, MI (US)

(72) Inventors: Swapnil V. Mohite, Pune (IN); Nivedita Nath, Pune (IN); Ravindra B. Salunkhe, Satara (IN); Ritesh D. Rokade, Pune (IN); Anil V. Bhosale, Satara (IN); Ketan S. Khedkar, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 402 days.

(21) Appl. No.: 16/250,906

(22) Filed: Jan. 17, 2019

(65) Prior Publication Data

US 2020/0224894 A1 Jul. 16, 2020

Related U.S. Application Data

(60) Provisional application No. 62/792,818, filed on Jan. 15, 2019.

(51) Int. Cl.
*F24F 3/153* (2006.01)
*F24F 3/14* (2006.01)
(Continued)

(52) U.S. Cl.
CPC ..... *F24F 3/153* (2013.01); *F24F 3/1405* (2013.01); *F25B 40/02* (2013.01); *F25B 41/31* (2021.01)

(58) Field of Classification Search
CPC .. F24F 3/153; F24F 3/1405; F24F 2203/1056; F24F 11/41; F24F 11/43; F25B 41/31; F25B 41/325; F25B 41/32; F25B 41/33; F25B 41/335; F25B 41/34; F25B 41/345; F25B 41/347; F25B 41/35; F25B 41/355; F25B 41/36; F25B 40/02; F25B 13/00; F25B 47/02; F25B 47/022;
(Continued)

(56) References Cited

U.S. PATENT DOCUMENTS 2,876,630 A * 3/1959 Boling ..... F25B 47/022 62/234
3,203,196 A * 8/1965 Malkoff ..... F25B 47/006 62/173

(Continued)

FOREIGN PATENT DOCUMENTS

WO 2008056374 A2 5/2008

*Primary Examiner* — Jianying C Atkisson
*Assistant Examiner* — Miguel A Diaz
(74) *Attorney, Agent, or Firm* — Fletcher Yoder, P.C.

(57) ABSTRACT

The present disclosure relates to a heating, ventilation, and/or air conditioning (HVAC) unit having a refrigerant circuit including a heat exchanger, an expansion valve, and a compressor. The heat exchanger includes a first coil and a second coil packaged in a common support structure. The HVAC unit further has a flow control system configured to direct refrigerant flow to the first coil from the expansion valve in a cooling mode of the HVAC unit and to the first coil from the compressor in a reheat mode of the HVAC unit, and configured to direct refrigerant flow to the second coil from the expansion valve in both the cooling mode and the reheat mode of the HVAC unit.

26 Claims, 7 Drawing Sheets

(51) Int. Cl.
*F25B 41/31* (2021.01)
*F25B 40/02* (2006.01)

(58) Field of Classification Search
CPC ..... F25B 47/025; F25B 2313/02322; F25B 2313/02332; F25B 2347/02; F25B 2347/021; F25B 2400/19
See application file for complete search history.

(56) References Cited

U.S. PATENT DOCUMENTS 5,065,586 A * 11/1991 Shapiro-Baruch ..... F24F 3/153 62/93
5,390,505 A * 2/1995 Smith ..... F25D 16/00 62/173
6,305,465 B1 * 10/2001 Uchikawa ..... F28D 1/0435 165/135
6,318,107 B1 * 11/2001 Pandaru ..... F25D 21/12 62/118
6,321,558 B1 11/2001 Pruse
6,769,481 B2 * 8/2004 Yoshimura ..... F24F 1/44 165/240
6,941,770 B1 * 9/2005 Taras ..... F24F 3/153 62/512
7,000,423 B2 * 2/2006 Lifson ..... F25B 41/40 62/324.1
7,028,492 B2 * 4/2006 Taras ..... B60H 1/3207 62/159
7,062,930 B2 * 6/2006 Rayburn ..... F25B 41/20 62/173
7,219,505 B2 * 5/2007 Weber ..... F24F 3/153 62/90
7,257,957 B2 8/2007 Lifson et al.
7,434,415 B2 * 10/2008 Knight ..... F25B 49/02 62/173
7,694,527 B2 * 4/2010 Knight ..... F24F 3/153 62/498
7,770,411 B2 * 8/2010 Knight ..... F25B 41/40 62/498
7,845,185 B2 * 12/2010 Knight ..... F24F 3/153 62/196.4
8,347,643 B2 1/2013 Taras et al.
8,397,522 B2 * 3/2013 Springer ..... F24F 3/153 62/93
9,322,581 B2 * 4/2016 Blanton ..... F24F 11/30
9,964,346 B2 5/2018 Hua
10,072,854 B2 * 9/2018 Blanton ..... F25B 47/022
10,746,444 B2 * 8/2020 Kim ..... F25D 21/12
10,746,445 B2 * 8/2020 Kim ..... F25D 11/02
10,746,455 B2 * 8/2020 Kim ..... F25D 11/022
10,830,501 B2 * 11/2020 Hern ..... G05D 23/1931
10,935,260 B2 * 3/2021 Taras ..... F24F 3/1405
10,948,203 B2 * 3/2021 Blanton ..... F25B 13/00
2002/0023443 A1 * 2/2002 Eber ..... F25B 41/20 62/172
2002/0050351 A1 * 5/2002 Yoshimura ..... F24F 1/06 165/240
2004/0089002 A1 * 5/2004 Rayburn ..... F24F 3/153 62/176.1
2004/0089015 A1 * 5/2004 Knight ..... F25B 41/20 62/324.1
2005/0235666 A1 * 10/2005 Springer ..... F24F 3/153 62/186
2006/0086115 A1 * 4/2006 Weber ..... F24F 3/153 62/196.4
2007/0169501 A1 * 7/2007 Rios ..... F24F 13/222 62/286
2007/0175227 A1 * 8/2007 Knight ..... F24F 3/153 62/176.1
2009/0095005 A1 * 4/2009 Dietrich ..... B60H 1/00907 62/244
2009/0277193 A1 * 11/2009 Springer ..... F24F 11/30 62/93
2011/0146306 A1 6/2011 Faras
2011/0154837 A1 6/2011 Taras
2012/0085114 A1 * 4/2012 Graaf ..... B60H 1/143 62/238.7
2012/0118533 A1 * 5/2012 Jang ..... F28F 27/02 165/96
2012/0272669 A1 * 11/2012 Blanton ..... F24F 1/00077 62/89
2013/0031934 A1 * 2/2013 Huff ..... F25B 1/10 62/510
2013/0098092 A1 * 4/2013 Wakamoto ..... F25B 5/02 62/278
2014/0151011 A1 * 6/2014 Kim ..... F28D 1/0477 165/185
2014/0245766 A1 * 9/2014 Wakamoto ..... F25B 47/022 62/151
2014/0260364 A1 * 9/2014 Litch ..... F28D 1/0477 62/82
2014/0262188 A1 * 9/2014 Sistla ..... F28F 1/32 165/182
2015/0052937 A1 * 2/2015 Hung ..... F24F 3/153 62/498
2015/0107286 A1 * 4/2015 Jin ..... F25B 30/02 62/222
2016/0033179 A1 * 2/2016 Kim ..... F25B 30/02 62/324.6
2016/0161191 A1 * 6/2016 Bunde-Pedersen ... F28D 9/0043 62/115
2016/0216025 A1 * 7/2016 Blanton ..... F25D 17/06
2016/0370046 A1 * 12/2016 Kim ..... F25D 23/006
2017/0030615 A1 * 2/2017 Kim ..... F25D 11/022
2017/0030627 A1 * 2/2017 Kim ..... F25B 47/022
2017/0131018 A1 * 5/2017 Shin ..... F25D 21/06
2017/0158027 A1 * 6/2017 Lee ..... F28F 9/0204
2017/0167766 A1 * 6/2017 Jeong ..... F28F 1/32
2017/0328594 A1 * 11/2017 Takeichi ..... F25B 41/31
2017/0336114 A1 * 11/2017 Lee ..... F25D 21/08
2018/0080693 A1 * 3/2018 Wang ..... H01M 10/6567
2018/0135915 A1 * 5/2018 Kester ..... F28F 9/0275
2018/0156476 A1 * 6/2018 McCarty ..... F24F 5/0092
2018/0231293 A1 * 8/2018 Blanton ..... F25B 49/027
2018/0292096 A1 * 10/2018 Onaka ..... F25B 41/00
2019/0178509 A1 * 6/2019 Taras ..... F25B 41/26
2019/0331367 A1 * 10/2019 Hern ..... G05D 23/1931
2019/0368754 A1 * 12/2019 Blanton ..... G05D 23/1919
2020/0132385 A1 * 4/2020 Choi ..... F25B 39/02
2020/0149751 A1 * 5/2020 Cho ..... F24F 1/0003
2020/0224894 A1 * 7/2020 Mohite ..... F25B 40/02
2020/0240681 A1 * 7/2020 Ryu ..... F25B 41/26
2020/0240682 A1 * 7/2020 Ryu ..... F25B 41/31
2020/0393177 A1 * 12/2020 Jin ..... F16L 13/141
2020/0408426 A1 * 12/2020 Goel ..... F25B 13/00

* cited by examiner

HOT GAS REHEAT SYSTEMS AND METHODS

CROSS REFERENCE TO RELATED APPLICATIONS

This application claims priority from and the benefit of U.S. Provisional Application Ser. No. 62/792,818, entitled "HOT GAS REHEAT SYSTEMS AND METHODS," filed Jan. 15, 2019, which is hereby incorporated by reference in its entirety for all purposes.

BACKGROUND

The present disclosure relates generally to heating, ventilation, and/or air conditioning (HVAC) systems. Specifically, the present disclosure relates to hot gas reheat (HGRH) systems and methods in HVAC systems.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A wide range of applications exist for HVAC systems. For example, residential, light commercial, commercial, and industrial systems are used to control temperatures and air quality in residences and buildings. Such systems often are dedicated to either heating or cooling, although systems are common that perform both of these functions. Very generally, these systems operate by implementing a thermal cycle in which fluids are heated and cooled to provide the desired temperature in a controlled space, typically the inside of a residence or building. Similar systems are used for vehicle heating and cooling, as well as for general refrigeration. In many HVAC systems, a reheat heat exchanger may be used to reheat supply air that is overcooled by an evaporator heat exchanger.

SUMMARY

The present disclosure relates to a heating, ventilation, and/or air conditioning (HVAC) unit having a refrigerant circuit including a heat exchanger, an expansion valve, and a compressor. The heat exchanger includes a first coil and a second coil packaged in a common support structure. The HVAC unit further has a flow control system configured to direct refrigerant flow to the first coil from the expansion valve in a cooling mode of the HVAC unit and to the first coil from the compressor in a reheat mode of the HVAC unit, and configured to direct refrigerant flow to the second coil from the expansion valve in both the cooling mode and the reheat mode of the HVAC unit.

The present disclosure also relates to a heating, ventilation, and/or air conditioning (HVAC) unit including a cooling circuit having a heat exchanger with a first coil and a second coil, a compressor disposed downstream of the heat exchanger, a condenser disposed downstream of the compressor, and an expansion valve disposed downstream of the condenser relative to refrigerant flow through the cooling circuit. The HVAC unit further includes a reheat circuit having the first coil of the heat exchanger, the expansion valve disposed downstream of the first coil, the second coil of the heat exchanger disposed downstream of the expansion valve, and the compressor disposed downstream of the second coil relative to refrigerant flow through the reheat circuit. The HVAC unit also includes a controller configured to operate the HVAC unit in a cooling mode such that refrigerant is directed along the cooling circuit to cool an airflow with refrigerant flowing through the first coil and configured to operate the HVAC unit in a reheat mode such that refrigerant is directed along the reheat circuit to heat the airflow with refrigerant flowing through the first coil.

The present disclosure further relates to a heating, ventilation, and/or air conditioning (HVAC) system having a refrigerant circuit including a compressor, a condenser, an expansion device, and a heat exchanger. The heat exchanger includes a first coil and a second coil packaged together in a common heat exchanger slab. The first coil and the second coil are fluidly separate from one another. The HVAC system further includes a control system configured to direct refrigerant from the expansion device to the first coil and from the expansion device to the second coil in a cooling mode of the HVAC system, and to direct refrigerant from the compressor to the first coil and from the expansion device to the second coil in a reheat mode of the HVAC system.

The present disclosure further relates to a heating, ventilation, and/or air conditioning (HVAC) system having a heat exchanger slab with a first coil and a second coil coupled to common end plates of the heat exchanger slab. The first coil and the second coil are fluidly separate from one another. The HVAC system further includes a flow control system configured to operate the HVAC system in a cooling mode and in a reheat mode. The flow control system is configured to flow refrigerant from an expansion device directly to both the first coil and the second coil in the cooling mode, and is configured to flow refrigerant from a compressor directly to the first coil and from the expansion device directly to the second coil in the reheat mode.

DRAWINGS

DETAILED DESCRIPTION

The present disclosure is directed to heating, ventilation, and/or air conditioning (HVAC) systems that are configured to provide conditioned air to a conditioned space in a cooling operating mode and in a hot gas reheat (HGRH) operating mode. In some instances, an HVAC system may include a condenser heat exchanger, an evaporator heat exchanger, and a reheat heat exchanger. During the HGRH operating mode, the reheat exchanger may be utilized to reheat air after the air is cooled by the evaporator heat exchanger. However, during the cooling operating mode, the reheat exchanger may be idle but may occupy valuable space within the HVAC system. Accordingly, the presence of an additional heat exchanger, such as the reheat heat exchanger, within the HVAC system may increase pressure drops for air flow within the HVAC system, which may cause an increase in blower output to move air through the HVAC system. As will be appreciated, this may decrease an overall efficiency of the HVAC system. Moreover, the presence of the additional heat exchanger may cause an increase in maintenance of the HVAC system, may reduce serviceability of the HVAC system, and may involve utilization of other additional expensive components, such as a three-way valve.

Accordingly, provided herein is an HVAC system that includes a heat exchanger configured to operate fully as an evaporator in a cooling operating mode of the HVAC system and configured to operate partially as a reheat heat exchanger and partially as an evaporator in an HGRH or dehumidification operating mode of the HVAC system. Thus, the disclosed embodiments provide an increase in efficiency of the HVAC system, such as by avoiding undesirable pressure drops and excess power consumption by the blower. The disclosed embodiments also enable a decrease in maintenance and improvements in serviceability of the HVAC system, such as by reducing an amount of components utilized to operate the HVAC system in the HGRH operating mode.

Figure 1:
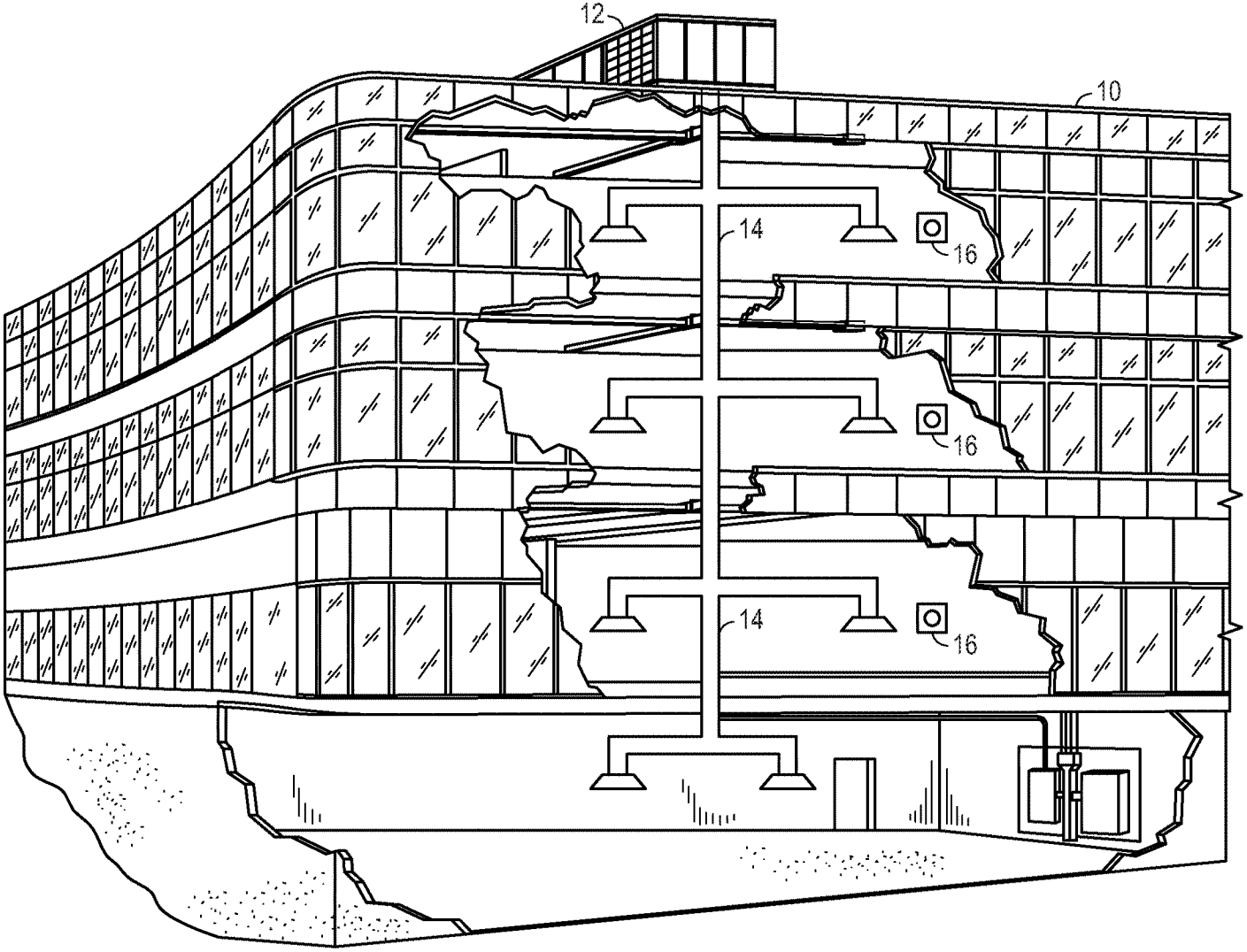
FIG. 1 is a perspective view of an embodiment of a heating, ventilation, and/or air conditioning (HVAC) system for building environmental management that may employ one or more HVAC units, in accordance with aspects of the present disclosure.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56. The HVAC unit 12 is an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
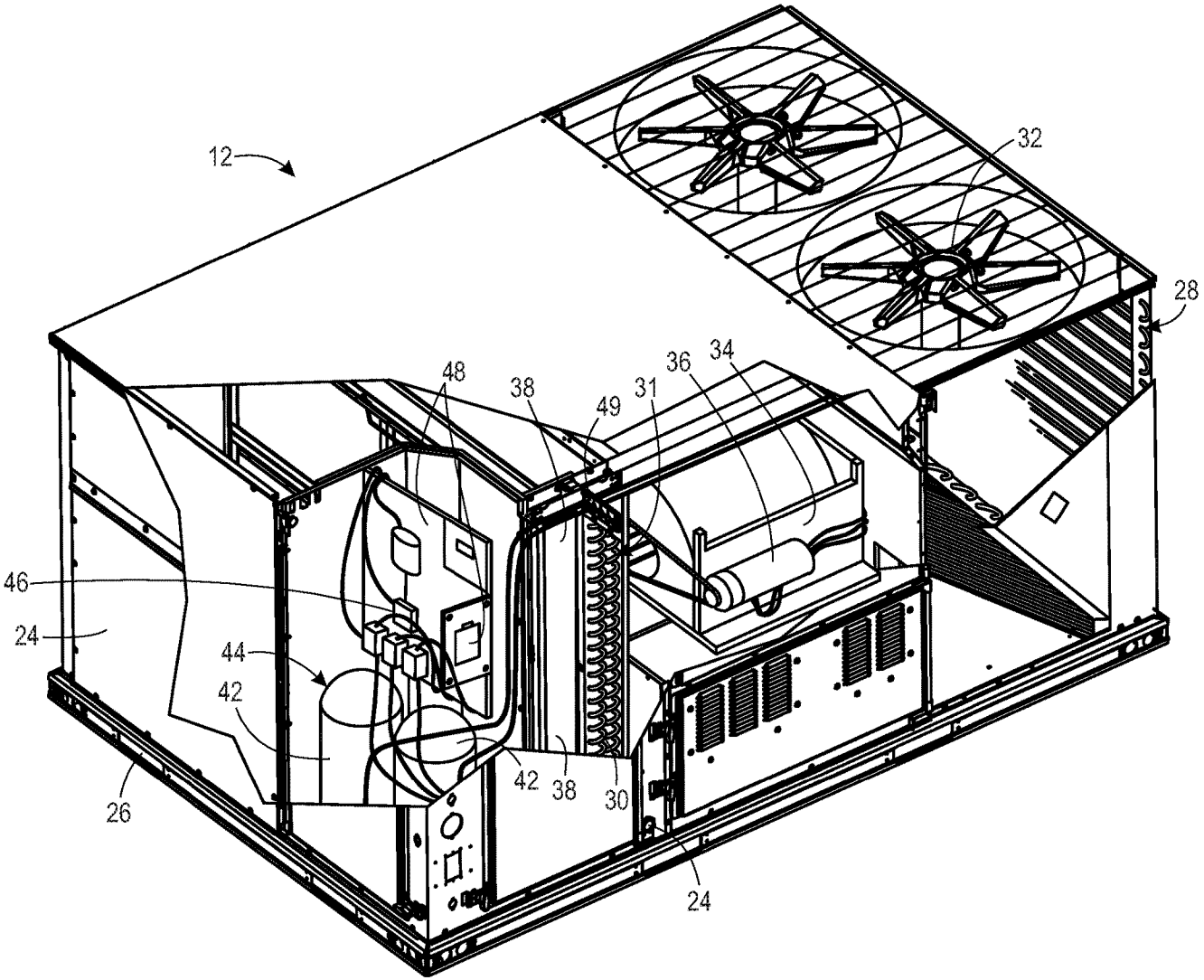
FIG. 2 is a perspective view of an embodiment of an HVAC unit that may be used in the HVAC system of FIG. 1, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the airflows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
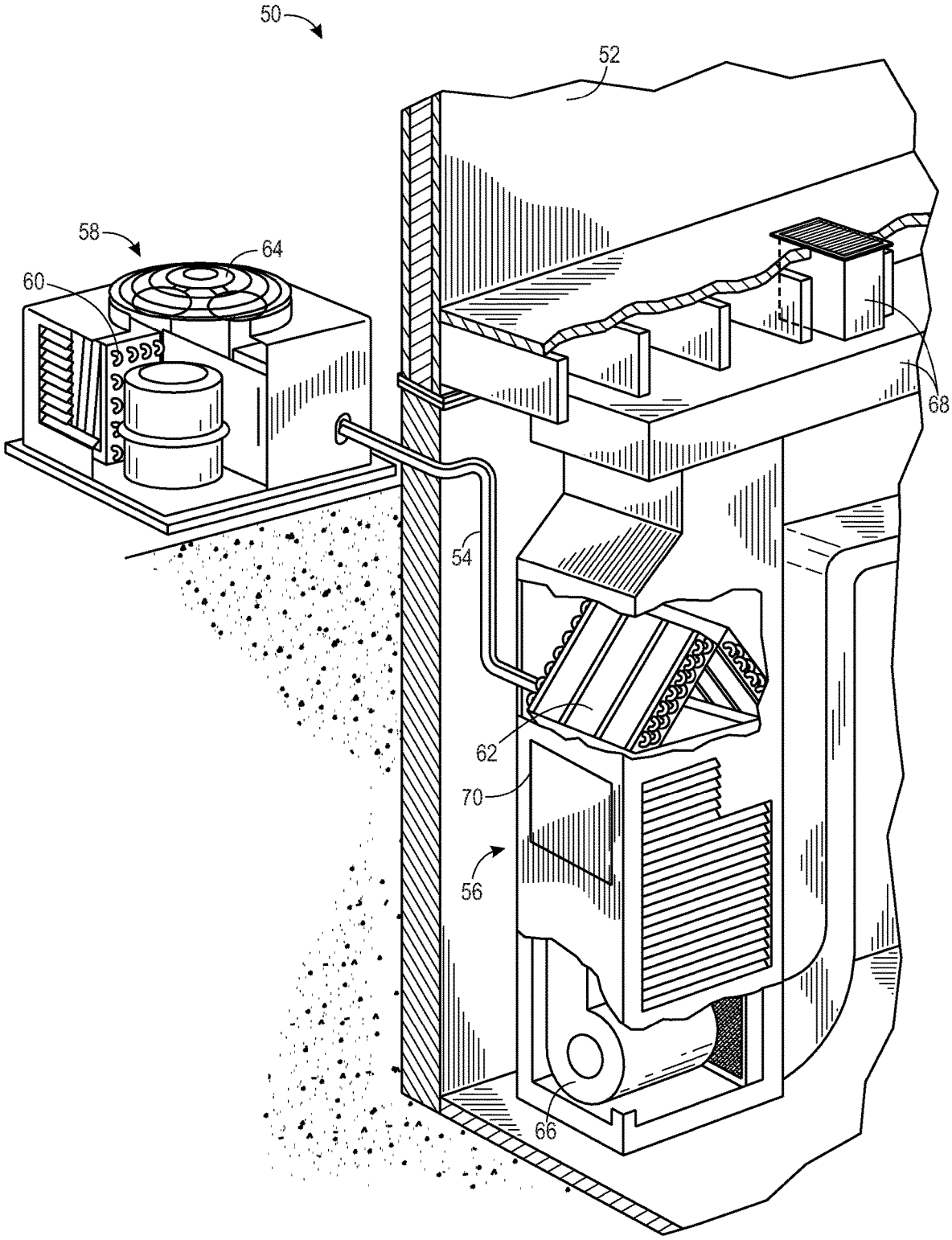
FIG. 3 is a perspective view of an embodiment of a residential, split heating and cooling system, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
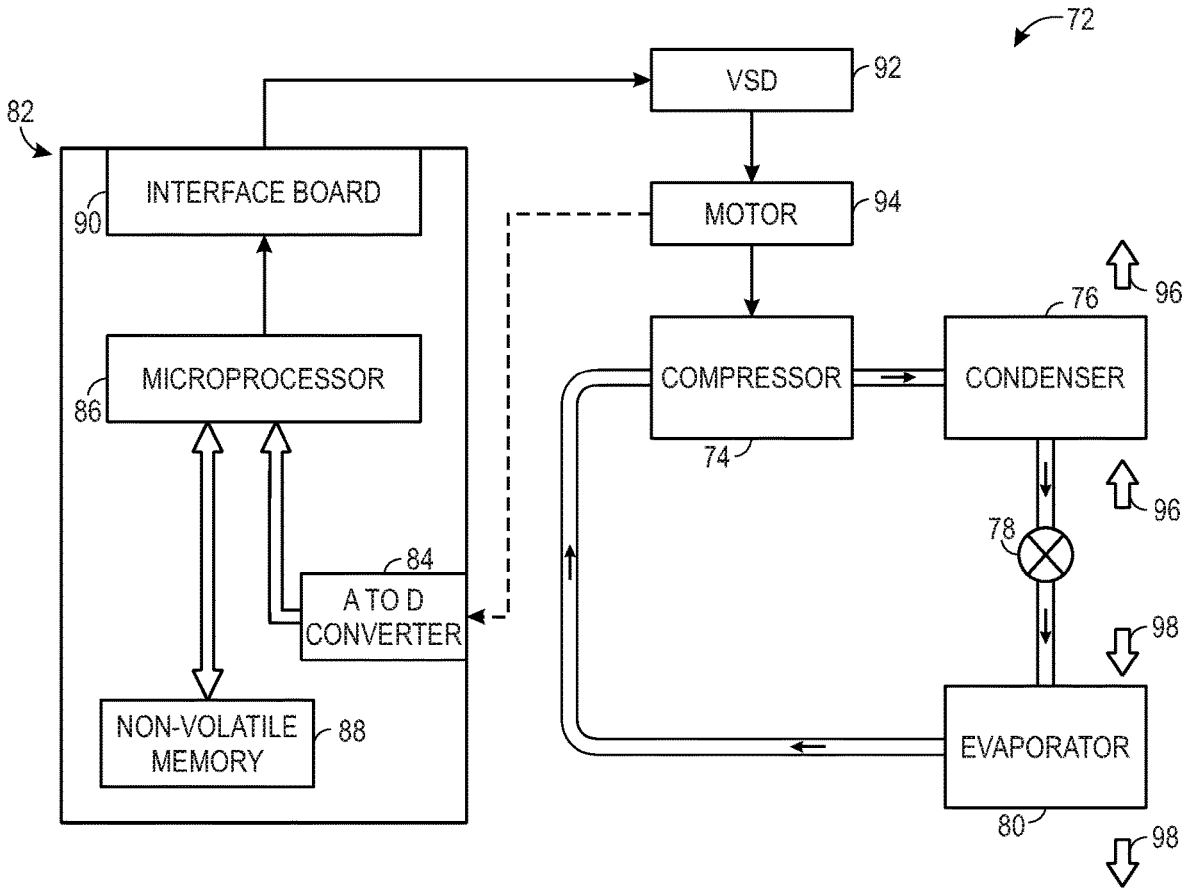
FIG. 4 is a schematic of an embodiment of a vapor compression system that may be used in an HVAC system, in accordance with aspects of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed below, a heating, ventilation, and/or air conditioning (HVAC) system 100, such as the HVAC unit 12, the residential heating and cooling system 50, and/or the vapor compression system 72, may be an air conditioning system configured to function in a cooling operating mode and in a hot gas reheat (HGRH) operating mode, which may be referred to as a reheat mode. In the cooling operating mode, the HVAC system 100 may utilize a heat exchanger as an evaporator in order to condition air, such as by cooling and dehumidifying the air, and may provide the resulting conditioned air to a conditioned space. In the HGRH operating mode, the HVAC system may utilize the heat exchanger as both an evaporator and as an HGRH heat exchanger. For example, a first portion of coils of the heat exchanger may function as an HGRH heat exchanger, and a second portion of coils of the heat exchanger may function as an evaporator. To this end, the second portion of coils may cool and dehumidify an airflow. The airflow may then pass over the first portion of coils, which heats the airflow to a suitable temperature before the airflow is supplied to the conditioned space.

Figure 5:
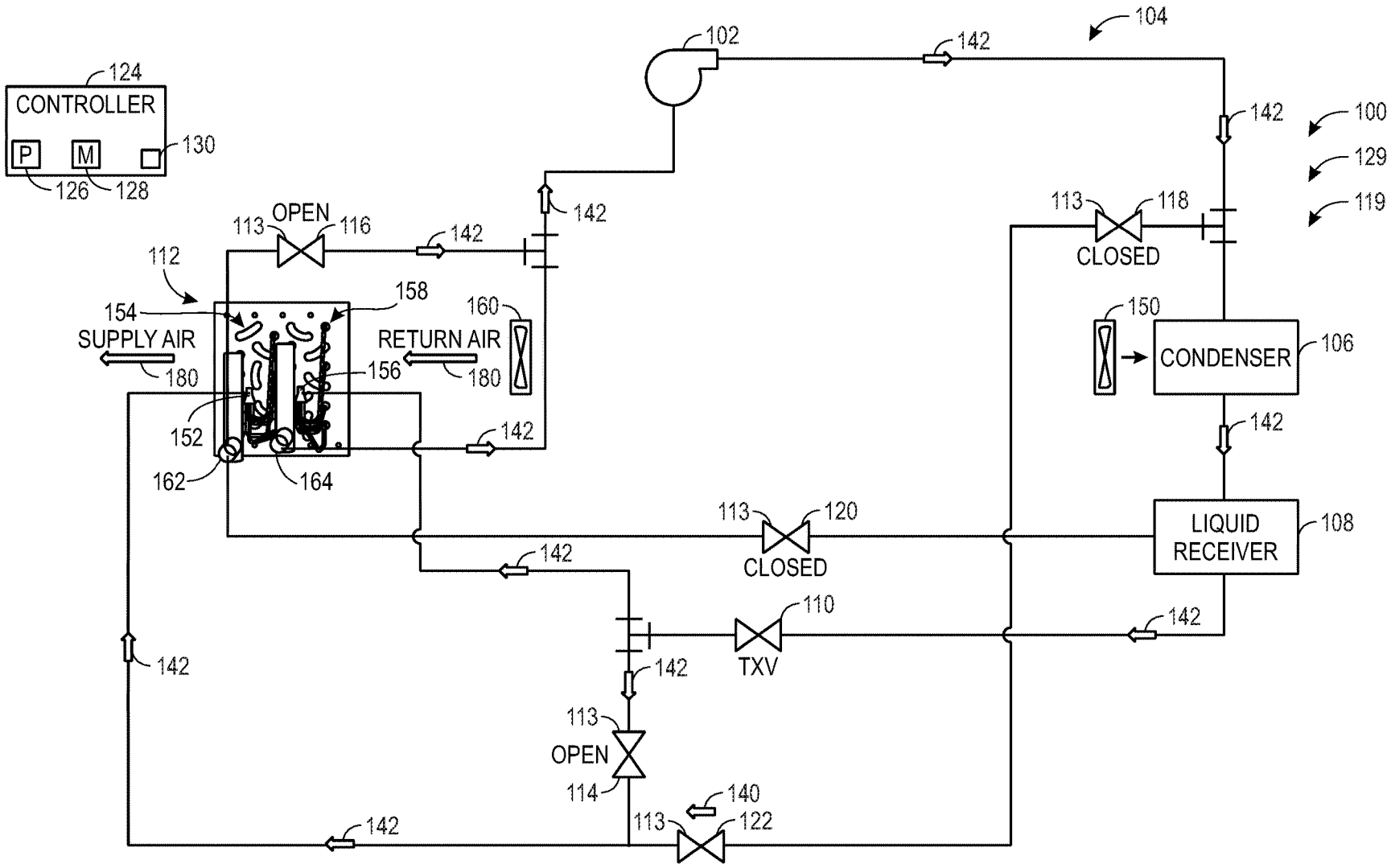
FIG. 5 is a schematic of an embodiment of an HVAC system in a cooling operating mode, in accordance with aspects of the present disclosure.

To illustrate, FIG. 5 is schematic of an embodiment of the HVAC system 100. In some embodiments, the HVAC system 100 may be a rooftop HVAC unit. The HVAC system 100 includes a compressor 102, such as the compressor 74, configured to flow refrigerant through a refrigerant circuit 104. The HVAC system 100 further includes a condenser 106, such as the condenser 76, a liquid receiver 108, an expansion device 110, such as the expansion device 78, a heat exchanger 112, such as a dual heat exchanger, and valves 113, such as a first valve 114, a second valve 116, a third valve 118, a fourth valve 120, and a fifth valve 122 disposed along the refrigerant circuit 104. As discussed herein, the valves 113 are configured to be operated to adjust a direction of flow of refrigerant through the refrigerant circuit 104. In other words, refrigerant flow through the refrigerant circuit 104 is subject to change based at least in part on positions of the valves 113. For example, as discussed in further detail below, the valves 113 may be operated to cause refrigerant to flow in a cooling circuit 119 of the refrigerant circuit 104 while the HVAC system 100 is in cooling operating mode or to cause refrigerant to flow in a reheat circuit 121 (FIG. 6) of the refrigerant circuit 104 while the HVAC system is in a HGRH operating mode.

Particularly, the positions of the valves 113 may be adjusted in response to signals output by a controller 124, such as the control panel 82 or an automation controller. The controller 124 may employ a processor 126, which may represent one or more processors, such as an application-specific processor. The controller 124 may also include a memory device 128 for storing instructions executable by the processor 126 to perform the methods and control actions described herein for the HVAC system 100. The processor 126 may include one or more processing devices, and the memory 128 may include one or more tangible, non-transitory, machine-readable media. By way of example, such machine-readable media can include RAM, ROM, EPROM, EEPROM, CD-ROM, or other optical disk storage, magnetic disk storage or other magnetic storage devices, or any other medium which can be used to carry or store desired program code in the form of machine-executable instructions or data structures and which can be accessed by the processor 126 or by any general purpose or special purpose computer or other machine with a processor. Indeed, the controller 124 may control a flow control system 129, which includes the valves 113, to control a direction of refrigerant flow through the refrigerant circuit 104.

The controller 124 may further include communication circuitry 130 configured to provide intercommunication between the systems/components of the HVAC system 100. In some embodiments, the communication circuitry 130 may communicate through a wireless network, such as wireless local area networks (WLAN), wireless wide area networks (WWAN), near field communication (NFC), Wi-Fi, and/or Bluetooth. In some embodiments, the communication circuitry 130 may communicate through a wired network such as local area networks (LAN), or wide area networks (WAN).

In the illustrated embodiment, the HVAC system 100 is in a cooling operating mode. That is, the HVAC system 100 is configured to provide a cooled, dehumidified airflow to a condition space, such as a building, residence, room, or office. While in the cooling operating mode, the first valve 114 is open, in order to enable a flow of refrigerant therethrough, the second valve 116 is open, the third valve 118 is closed, in order to block or inhibit a flow of refrigerant therethrough, and the fourth valve 120 is closed. In the current embodiment, the fifth valve 122 may be a one-way check valve configured to permit refrigerant to flow in a direction 140 therethrough and to block refrigerant flow therethrough in a direction opposite the direction 140. Accordingly, as indicated by arrows 142, the refrigerant may flow in conduits through the cooling circuit 119 of the refrigerant circuit 104 from the compressor 102, to the condenser 106, to the liquid receiver 108, to the expansion device 110, to the heat exchanger 112, and back to the compressor 102.

For example, the compressor 102 may deliver refrigerant in a vaporous state to the condenser 106. The refrigerant flows through coils of the condenser 106, such that the condenser 106 places the refrigerant in a heat exchange relationship with an airflow flowing across coils of the condenser 106. As such, the airflow absorbs heat from the refrigerant within the condenser 106, and the refrigerant condenses into a liquid. Particularly, in some embodiments, the HVAC system 100 may include a blower 150, such as a fan, configured to move air across the coils of the condenser 106 to enable heat exchange between the airflow and the refrigerant within the condenser 106. The refrigerant then flows from the condenser 106 to the liquid receiver 108 and then to the expansion device 110. The liquid receiver 108 is configured to regulate a flow of the refrigerant to the expansion device 110. The expansion device 110 then expands the refrigerant, which causes a decrease in the pressure of the refrigerant. From the expansion device 110, the refrigerant flows to the heat exchanger 112.

Specifically, as shown, the heat exchanger 112 may include a first distributer 152 configured to route refrigerant to a first coil 154 of the heat exchanger 112. The heat exchanger 112 further includes a second distributer 156 configured to route refrigerant to a second coil 158 of the heat exchanger 112. Indeed, as discussed in further detail below, the first coil 154 and the second coil 158 are fluidly separate from one another within the heat exchanger 112 but are packaged together within in a common heat exchanger slab of the heat exchanger 112 with common endplates. Particularly, the first coil 154 and the second coil 158 are considered fluidly separate from one another with respect to refrigerant flow within the heat exchanger 112, but it is to be understood that refrigerant flows within first coil 154 and the second coil 158 may be combined or mixed along the refrigerant circuit 104 external to the heat exchanger 112.

Accordingly, from the expansion device 110, refrigerant may flow through the refrigerant circuit 104 to both the first distributer 152 and the second distributer 156 of the heat exchanger 112. In the current embodiment, the heat exchanger 112 may function as an evaporator. More specifically, in the illustrated embodiment, both the first coil 154 and the second coil 158 may collectively function as an evaporator by placing the refrigerant in a heat exchange relationship with an airflow 180 passing over the first coil 154 and the second coil 158. To this end, the HVAC system may include a blower 160, such as a fan, configured to move the airflow 180 across the first coil 154 and the second coil 158. In certain embodiments, the airflow 180 forced across the first coil 154 and the second coil 158 may be a return air flow, an outdoor air flow, or other suitable air flow. Additionally, by virtue of the packaged arrangement of the heat exchanger 112 coils 154, 158, the air flow may be forced sequentially across the second coil 158 and the first coil 154. In other words, in the illustrated embodiment, the air flow is forced across the second coil 158 and then across the first coil 154. As the heat exchanger 112 operates as an evaporator in the cooling operating mode, the respective refrigerant flows within the first coil 154 and the second coil 158 may absorb heat from the airflow 180, thereby evaporating the respective refrigerant flows within the first coil 154 and the second coil 158. The refrigerant flows may then flow from the first coil 154 and the second coil 158 through a first header 162 and through a second header 164, respectively. The refrigerant may then flow from the first header 162 and the second header 164 back to the compressor 102. Particularly, having the second valve 116 open and the fourth valve 120 closed may cause the refrigerant to flow from the first header 162 to the compressor 102.

While the HVAC system 100 is in the cooling operating mode, the first valve 114 may permit a refrigerant flow from the expansion device 110 to the first coil 154, the second valve may permit a refrigerant flow from the first coil 154 to the compressor, the third valve 118 may block a refrigerant flow from the compressor the first coil 154, the fourth valve 120 may block a refrigerant flow from the first coil 154 to the liquid receiver 108 and/or expansion device, and the fifth valve 122 may block a refrigerant flow from the expansion device 110 toward the condenser 106. Indeed, the first valve 114 may allow a refrigerant flow from the expansion device 110 to split to go to both the first coil 154 and the second coil 158 while the fifth valve 122 block refrigerant from flowing upstream toward the condenser 106. Accordingly, while in the cooling operating mode, the HVAC system 100 may provide a conditioned airflow, such as a cooled and dehumidified airflow, to a conditioned space. That is, the conditioned airflow that is conditioned by exchanging heat with refrigerant flowing through the heat exchanger 112 may be provided to the conditioned space. The HVAC system 100 may operate in the cooling operating mode if a measured temperature of the conditioned space is above a set point or target temperature of the conditioned space, such as during summer months.

As discussed herein, the condenser 106 may be considered as disposed directly downstream of the compressor 102, the expansion device 110 may be considered as disposed directly downstream of the condenser 102, the heat exchanger 112 may be considered as disposed directly downstream of the expansion device 110, and the compressor 102 may be considered as disposed directly downstream of the heat exchanger 112 along the refrigerant circuit 104. Indeed, while certain components, such as the liquid receiver 108 and the valves 113, may be disposed along the refrigerant circuit 104 between the condenser 106, the expansion device 110, the heat exchanger 112, and/or the compressor 102, these certain components may not substantially necessarily alter fluid characteristics, such as temperature and pressure, of the refrigerant. More specifically, these certain components are not included for the intention of altering fluid characteristics of the refrigerant. For example, while the liquid receiver may be disposed between the condenser 106 and the expansion device 110 along the refrigerant circuit 104, the expansion device 110 may still be considered directly downstream of the condenser 106 because the liquid receiver 108 may not significantly or substantially alter the fluid characteristics of the refrigerant.

Figure 6:
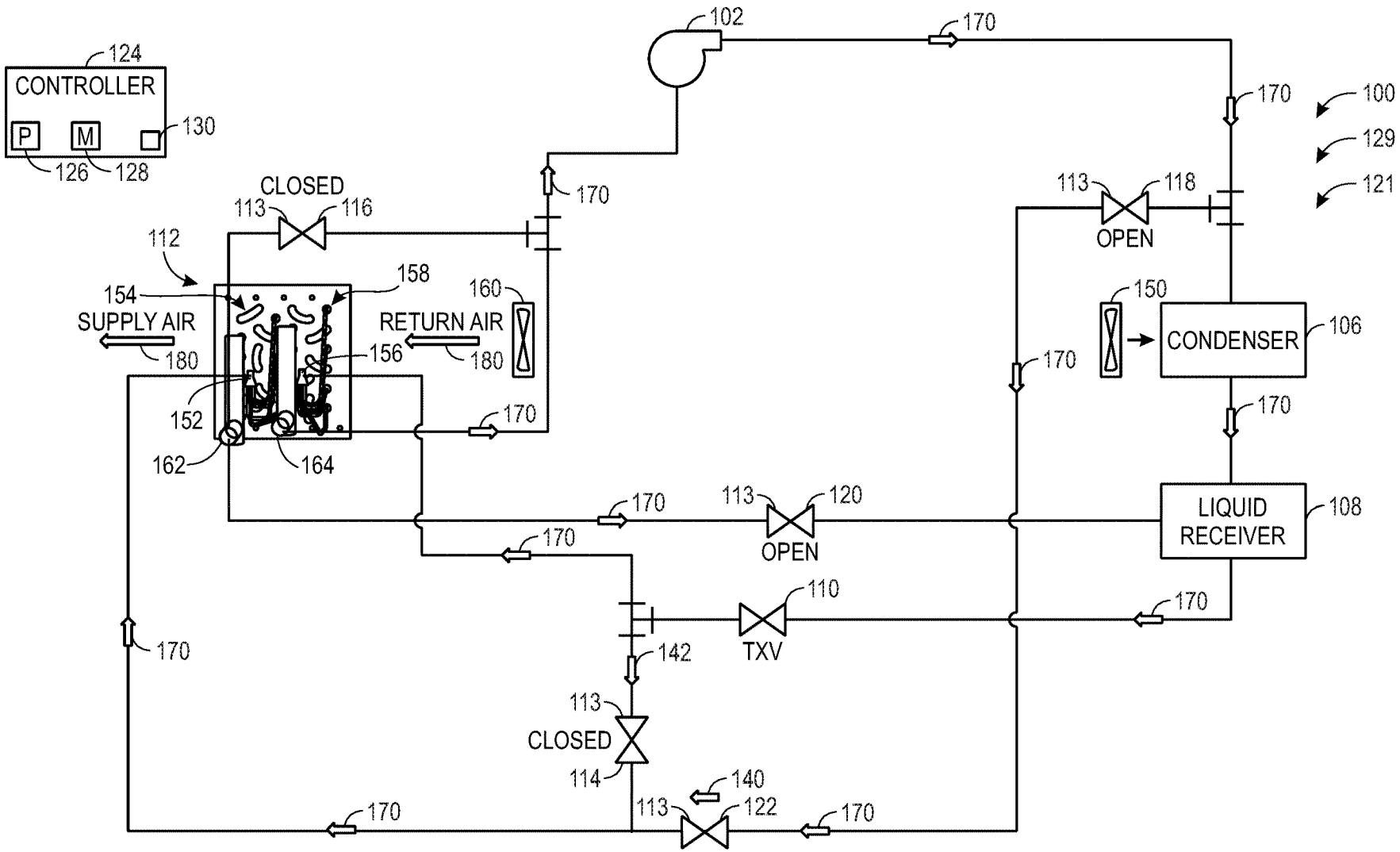
FIG. 6 is a schematic of an embodiment of the HVAC system of FIG. 5 in a hot gas reheat (HGRH) operating mode, in accordance with aspects of the present disclosure.

FIG. 6 is a schematic of an embodiment of the HVAC system 100 in an HGRH operating mode. As shown, the HVAC system 100 includes the refrigerant circuit 104 having the compressor 102, the condenser 106, the liquid receiver 108, the expansion device 110, the heat exchanger 112, and the valves 113, as similarly described above with reference to FIG. 5. As shown, while in the HGRH operating mode, the first valve 114 is closed, the second valve 116 is closed, the third valve 118 is open, and the fourth valve 120 is open. As discussed above, the fifth valve 122 may be a one-way check valve configured to enable refrigerant to flow therethrough in the direction 140, while blocking refrigerant flow therethrough in a direction opposite direction 140. Accordingly, the refrigerant may flow in conduits through the reheat circuit 121 of the refrigerant circuit 104 as indicated by arrows 170.

In some embodiments, the third valve 118 may be a modulating valve. That is, the third valve 118 may be configured to open partially so as to selectively enable a partial flow of refrigerant threrethrough. For example, a first portion of the refrigerant may flow from the compressor 102, through the third valve 118, and to the first coil 154 of the heat exchanger 112. Further, a second portion of the refrigerant may flow from the compressor 102 may not flow through the third valve 118 and may instead flow to the condenser 106. The second portion of the refrigerant may be placed in a heat exchange relationship with an airflow passing over coils of the condenser 106. That is, the condenser 106 may condense the second portion of refrigerant by decreasing a temperature of the second portion of refrigerant. The second portion of refrigerant may then flow from the condenser 106 to the expansion device 110 through the liquid receiver 108. Indeed, as discussed above, the liquid receiver 108 may regulate a flow of refrigerant to the expansion device 110. As discussed in further detail below, the liquid receiver 108 may also receive the first portion of refrigerant from the first coil 154 of the heat exchanger 112. For example, the liquid receiver 108 may receive subcooled refrigerant from both the first coil 154 and the condenser 106. Accordingly, the liquid receiver 108 may regulate a flow of refrigerant containing both the first and second portions of the refrigerant to the expansion device 110. The expansion device 110 may then expand the refrigerant and thereby decrease a pressure of the refrigerant. From the expansion device 110, the refrigerant may flow to the second coil 158 of the heat exchanger 112.

Indeed, as discussed above, the first coil 154 of the heat exchanger 112 may receive refrigerant from the compressor 102 via the third valve 118, and the second coil 158 may receive refrigerant from the expansion device 110. In this manner, as the blower 160 moves air sequentially across the second coil 158 and the first coil 154 of the heat exchanger 112, the second coil 158 may function as an evaporator, and the first coil 154 may function as a condenser and/or a reheat heat exchanger. To illustrate, the airflow 180 may be moved across the heat exchanger 112 by first passing across the second coil 158 and then passing across the first coil 154. In this manner, refrigerant flowing through the second coil 158, the pressure and temperature of which has dropped via the expansion device 110, may be placed in a heat exchanger relationship with the airflow 180. As a result, the refrigerant within the second coil 158 absorbs heat from the airflow 180, decreases a temperature of the airflow 180, and dehumidifies the airflow 180 by condensing moisture within the airflow 180. As such, the refrigerant flowing through the second coil 158 may evaporate.

After passing over the second coil 158, the airflow 180 may continue through the heat exchanger 112 and may pass over the first coil 154, thereby placing the refrigerant within the first coil 154 in a heat exchange relationship with the airflow 180. As noted above, the refrigerant within the first coil 154 is supplied via the third valve 118 and has not yet passed through the condenser 106 or the expansion device 110. Therefore, the refrigerant within the first coil 154 is at an elevated temperature and pressure as compared to the refrigerant within the second coil 158. Accordingly, the airflow 180 may absorb heat from the refrigerant within the first coil 154, thereby increasing a temperature of the airflow 180 and condensing the refrigerant within the first coil 154. In this manner, the second coil 158 may cool and dehumidify the airflow 180, while the first coil 154 may reheat the airflow 180 to a desired temperature. In some embodiments, the amount of heat transferred from the refrigerant within the first coil 154 to the airflow 180 may depend on a rate of flow of refrigerant through the first coil 154. Particularly, the rate of flow of refrigerant through the first coil 154 may be controlled by a position of the third valve 118, which may be a modulating valve, as discussed above. Accordingly, the controller 124 may control a position of the third valve 118 to control a temperature of the airflow 180 as it exits the heat exchanger 112 and is supplied to the conditioned space.

After flowing through the first coil 154, the refrigerant may flow through the first header 162 to the liquid receiver 108. Indeed, unlike in the cooling operating mode illustrated in FIG. 5, the second valve 116 is closed, and the fourth valve 120 is open. Therefore, refrigerant exiting the first coil 154 is directed from the first header 162 of the first coil 154 to the liquid receiver 108. Indeed, the liquid receiver 108 may receive refrigerant from both the condenser 106 and the first coil 154 in the illustrated configuration of the HGRH operating mode. Further, after flowing through the second coil 158, the refrigerant may flow through the second header 164 to the compressor 102. To further illustrate, while the HVAC system 100 is in the HGRH operating mode, the first valve 114 may block a refrigerant flow from the expansion device 110 to the first coil 154, the second valve 116 may block a refrigerant flow from the first coil 154 to the compressor 102, the third valve 118 may allow a refrigerant flow from the compressor to the first coil 154, the fourth valve 120 may permit a refrigerant flow from the first coil 154 to the liquid receiver 108, and the fifth valve 122 may permit a flow of refrigerant from the compressor to the first coil 154.

In the illustrated configuration, the condenser 106 and the first coil 154 may both be considered as disposed directly downstream of the compressor 102 along the refrigerant circuit 104. Further, the expansion device 110 may be considered as disposed directly downstream of both the condenser 106 and the first coil 154 along the refrigerant circuit 104 in the illustrated configuration. Further still, the second coil 158 may be considered as disposed directly downstream of the expansion device 110, and the compressor 102 may be considered as disposed directly downstream of the second coil 158 along the refrigerant circuit 104 in the illustrated configuration. In other words, the positions of the valve 113 along the refrigerant circuit 104 may be changed to effectuate different arrangements of various components, such as the compressor 102, condenser 106, expansion device 110, first coil 154, and second coil 158, relative to one another along the refrigerant circuit 104. In this way, the operation of certain components of the HVAC system 100 may be adjusted. For example, in the illustrated configuration of FIG. 5, the first coil 154 operates as an evaporator to cool the airflow 180, whereas, in the illustrated configuration of FIG. 6, the first coil 154 operates as a reheat heat exchanger to heat the airflow 180.

The HVAC system 100 may operate in the HGRH operating mode or a dehumidification operating mode, as shown in FIG. 6, during cooler, more humid months. For example, return air pulled from a conditioned space may be at a sufficiently low temperature or below a set point temperature of the conditioned space, but may be above a preferred humidity level. Accordingly, to dehumidify the return air, the second coil 158 decreases a temperature of the return air, thereby condensing the moisture in the return air. However, the temperature of the dehumidified air may be below a set point temperature of the conditioned space. Accordingly, the first coil 154 is used to reheat the air coming from the second coil 158 to a suitable temperature before the air is supplied to the conditioned space.

Figure 7:
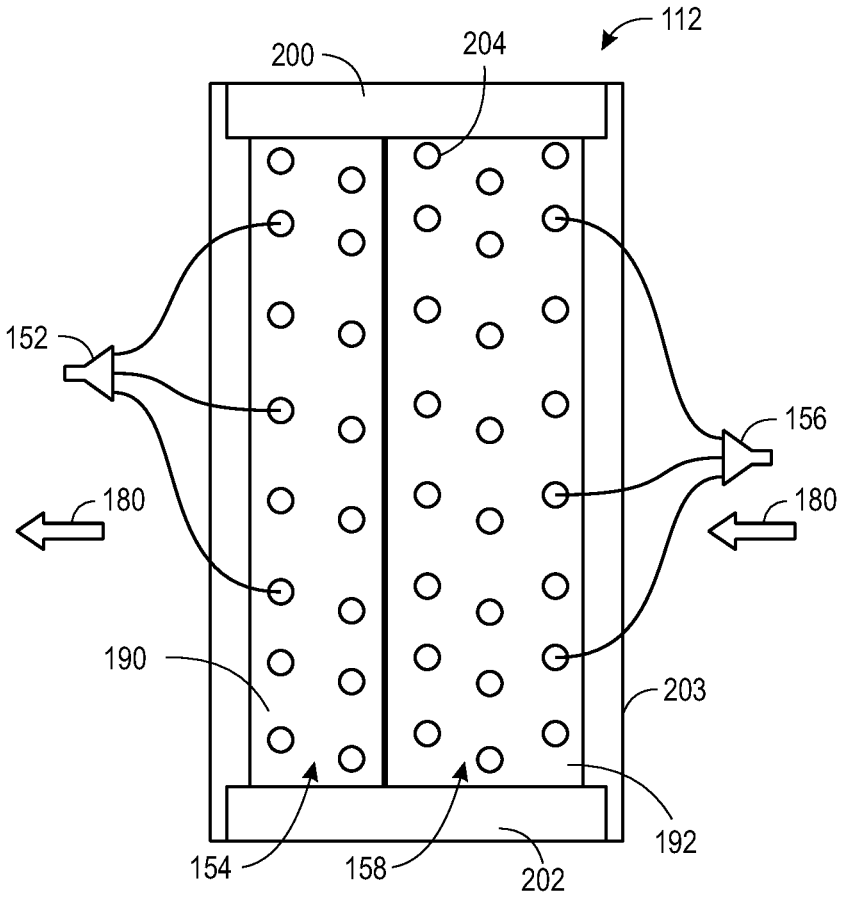
FIG. 7 is a schematic of an embodiment of a heat exchanger that may be utilized as an evaporator heat exchanger and/or a HGRH heat exchanger within the HVAC system of FIG. 5, in accordance with aspects of the present disclosure.

As discussed herein, the first coil 154 and the second coil 158 are packaged together within the heat exchanger 112. The heat exchanger 112 further includes the first distributer 152 configured to route refrigerant to the first coil 154 and the second distributer 156 configured to route refrigerant to the second coil 158. To illustrate, FIG. 7 is a schematic side view of an embodiment of the heat exchanger 112. As shown, the heat exchanger 112 includes the first coil 154 configured to receive refrigerant from the first distributer 152 and the second coil 158 configured to receive refrigerant from the second distributer 156. As also shown, the first coil 154 is supported by a first set of heat exchanger fins 190, and the second coil 158 is supported by a second set of heat exchanger fins 192. The first and second sets of heat exchanger fins 190, 192 are both supported by a first end plate 200 and a second end plate 202. In other words, both the first coil 154 and the second coil 158 are supported by both the first and second end plates 200, 202. The first coil 154, the second coil 158, the first set of heat exchanger fins 190, and the second set of heat exchanger fins 192 are all packaged together in a common heat exchanger slab 203, such as housing or support structure of the heat exchanger 112.

Further, it should be understood that the illustration of FIG. 7 has been intentionally simplified to focus on certain aspects of the disclosed embodiments. For example, as shown, each circle 204 of the coils 154, 158 may represent a pass of tubing of the coils 154, 158 through the fins 190, 192 of the heat exchanger 112. Indeed, as shown, the first coil 154 may include tubing arranged in two columns relative to the direction of airflow 180 through the heat exchanger 112, and the second coil 158 may include tubing arranged in three columns relative to the direction of airflow 180 through the heat exchanger 112. Accordingly, in some embodiments of the HGRH operating mode, the position of the third valve 118 may be adjusted such that the first coil 154 receives approximately 30% of the refrigerant flow discharged by the compressor 102, while the second coil 158 may receive 100% of the refrigerant flow via the liquid receiver 108 that combines refrigerant flows from the first coil 154 and the condenser 106. Indeed, it should be appreciated that the liquid receiver 108 may operate to ensure that an appropriate amount of refrigerant is supplied to the expansion device 110 after the refrigerant flows from the first coil 154 and the condenser 106 are combined at the liquid receiver 108.

Further, it should be understood that the coils 154, 158 may pass through multiple sheets of metal of the heat exchanger fins 190, 192. Indeed, the airflow 180 may pass over the first and second coils 154, 158 and in between layers or sheets of the heat exchanger fins 190, 192. In some embodiments, the first set of heat exchanger fins 190 may be separate from the second set of heat exchanger fins 192. In some embodiments, the first set of heat exchanger fins 190 may be in contact with the second set of heat exchanger fins 192 but may not be fastened or secured to the second set of heat exchanger fins 192. Further, in some embodiments, the first set of heat exchanger fins 190 may be directly adjacent to the second set of heat exchanger fins 192 and may include a small gap between the first set of heat exchanger fins 190 and the second set of heat exchanger fins 192. Still further, in some embodiments, the first set of heat exchanger fins 190 and the second set of heat exchanger fins 192 may be a continuous set of fins and/or may be directly coupled together, such as by welding.

It should be noted that illustrations of the first header 162 and the second header 164 have been omitted in FIG. 7 to focus on the structure of the heat exchanger 112. After the refrigerant flows from the first distributer 152 and through the first coil 154, the refrigerant may flow through the first header 162. After passing through the first header 162, the refrigerant may flow to the compressor 102 if the HVAC system 100 is in the cooling operating mode, or the refrigerant may flow to the liquid receiver 108 if the HVAC system 100 is in the HGRH operating mode, as discussed above. Similarly, after the refrigerant flows from the second distributer 156 and through the second coil 158, the refrigerant may flow to the compressor 102 if the HVAC system 100 is in either the cooling operating mode or the HGRH operating mode.

Accordingly, the present disclosure is directed to an HVAC system, such as an air conditioning system, configured to operate in both a cooling operating mode and in a HGRH operating mode. To this end, the HVAC system includes a heat exchanger that is configured to operate fully as an evaporator while the HVAC system is in the cooling operating mode and is configured to operate as both an evaporator and a condenser/reheat heat exchanger while the HVAC system is in an HGRH operating mode. Particularly, the heat exchanger may include two fluidly separate coils configured to receive refrigerant from the same or separate sources of the HVAC system, depending on the mode of the HVAC system. As such, the disclosed embodiments do not include a third, separate heat exchanger for a reheat operating mode of the HVAC system. Indeed, a separate reheat heat exchanger, in addition to a condenser and an evaporator, may increase pressure drops for airflow through in the HVAC system, thereby leading to an increase in blower output to overcome the increased pressure drops, which decreases an efficiency of the HVAC system. The presence of a separate reheat heat exchanger within the HVAC system may also increase maintenance frequency, decrease ease of access for maintenance in the HVAC system, and may increase a cost of the HVAC system. For example, in some embodiments, the separate reheat heat exchanger may involve utilization of additional, expensive components, such as three-way valves.

While only certain features and embodiments of the present disclosure have been illustrated and described, many modifications and changes may occur to those skilled in the art, such as variations in sizes, dimensions, structures, shapes and proportions of the various elements, values of parameters, such as temperatures or pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) unit, comprising:

a refrigerant circuit including a heat exchanger, an expansion valve, a condenser, a liquid receiver, a plurality of valves, and a compressor, wherein the heat exchanger includes a first coil and a second coil packaged in a common support structure, and wherein the plurality of valves comprises:

a first valve disposed along the refrigerant circuit downstream of the expansion valve and upstream of the first coil relative to a first direction of refrigerant flow through the first valve;

a second valve disposed along the refrigerant circuit downstream of the first coil and upstream of the compressor relative to a second direction of refrigerant flow through the second valve;

a third valve disposed along the refrigerant circuit downstream of the compressor and upstream of the first coil relative to a third direction of refrigerant flow through the third valve; and a fourth valve disposed along the refrigerant circuit downstream of the first coil and upstream of the liquid receiver relative to a fourth direction of refrigerant flow through the fourth valve; and a flow control system configured to adjust a respective position of each valve of the plurality of valves to direct refrigerant flow to the first coil from the expansion valve in a cooling mode of the HVAC unit and to the first coil from the compressor in a reheat mode of the HVAC unit, and configured to direct refrigerant flow to the second coil from the expansion valve in both the cooling mode and the reheat mode of the HVAC unit.

2. The HVAC unit of claim 1, wherein the common support structure includes a first end plate and a second end plate, and wherein the first coil and the second coil both extend between the first end plate and the second end plate.

3. The HVAC unit of claim 1, wherein the flow control system is configured to open the second valve to direct refrigerant flow to the compressor from the first coil in the cooling mode of the HVAC unit.

4. The HVAC unit of claim 1, wherein the flow control system is configured to open the fourth valve to direct refrigerant flow to the liquid receiver from the first coil in the reheat mode of the HVAC unit.

5. The HVAC unit of claim 1, wherein the refrigerant circuit is configured to direct refrigerant flow to the compressor from the second coil in both the cooling mode and the reheat mode of the HVAC unit.

6. The HVAC unit of claim 1, wherein the third valve is a modulating valve, and wherein the flow control system is configured to, during the reheat mode, actuate the modulating valve to direct a first refrigerant flow from the compressor to the condenser, and to direct a second refrigerant flow from the compressor to the first coil.

7. The HVAC unit of claim 1, wherein the flow control system includes an automation controller configured to manage operation of the plurality of valves.

8. The HVAC unit of claim 1, wherein the flow control system is configured to operate the HVAC unit such that the first coil and the second coil both evaporate refrigerant in the cooling mode of the HVAC unit.

9. The HVAC unit of claim 8, wherein the flow control system is configured to operate the HVAC unit such that the first coil condenses refrigerant in the reheat mode of the HVAC unit, and wherein the flow control system is configured to operate the HVAC unit such that the second coil evaporates refrigerant in the reheat mode of the HVAC unit.

10. A heating, ventilation, and/or air conditioning (HVAC) unit, comprising:

a cooling circuit having a heat exchanger with a first coil and a second coil, a compressor disposed downstream of the heat exchanger, a condenser disposed downstream of the compressor, a liquid receiver disposed downstream of the condenser, and an expansion valve disposed downstream of the liquid receiver relative to refrigerant flow through the cooling circuit;

a reheat circuit having the first coil of the heat exchanger, the liquid receiver disposed downstream of the first coil, the expansion valve disposed downstream of the liquid receiver, the second coil of the heat exchanger disposed downstream of the expansion valve, and the compressor disposed downstream of the second coil relative to refrigerant flow through the reheat circuit;

a refrigerant circuit comprising the cooling circuit, the reheat circuit, and a plurality of valves, wherein the plurality of valves comprises:

a first valve disposed along the refrigerant circuit downstream of the expansion valve and upstream of the first coil relative to a first direction of refrigerant flow through the first valve;

a second valve disposed along the refrigerant circuit downstream of the first coil and upstream of the compressor relative to a second direction of refrigerant flow through the second valve;

a third valve disposed along the refrigerant circuit downstream of the compressor and upstream of the first coil relative to a third direction of refrigerant flow through the third valve; and a fourth valve disposed along the refrigerant circuit downstream of the first coil and upstream of the liquid receiver relative to a fourth direction of refrigerant flow through the fourth valve; and a controller configured to control a respective position of each valve of the plurality of valves and to operate the HVAC unit in a cooling mode such that refrigerant is directed along the cooling circuit to cool an airflow with refrigerant flowing through the first coil and configured to operate the HVAC unit in a reheat mode such that refrigerant is directed along the reheat circuit to heat the airflow with refrigerant flowing through the first coil.

11. The HVAC unit of claim 10, wherein the heat exchanger includes a first end plate and a second end plate, and wherein both the first coil and the second coil are coupled to and extend between the first end plate and the second end plate.

12. The HVAC unit of claim 10, wherein the heat exchanger includes a first header configured to receive refrigerant from the first coil and a second header configured to receive refrigerant from the second coil, and wherein the controller is configured to operate the HVAC unit in the cooling mode such that the first header and the second header route refrigerant from the first coil and the second coil, respectively, to the compressor and, wherein the controller is configured to operate the HVAC unit in the reheat mode such that the first header routes refrigerant from the first coil through the fourth valve to the liquid receiver, and the second header routes refrigerant from the second coil to the compressor.

13. The HVAC unit of claim 10, wherein the first coil includes tubing arranged in two columns within the heat exchanger, and the second coil includes tubing arranged in three columns within the heat exchanger.

14. The HVAC unit of claim 10, wherein heat exchanger includes a first distributer configured to receive refrigerant and route refrigerant to the first coil and includes a second distributer configured to receive refrigerant and route refrigerant to the second coil.

15. The HVAC unit of claim 10, comprising a check valve disposed along the refrigerant circuit and configured to block refrigerant flow from the expansion valve to the condenser in the cooling mode and configured to enable refrigerant flow from the compressor to the first coil in the reheat mode.

16. The HVAC unit of claim 10, wherein the liquid receiver is disposed directly downstream of the condenser in the cooling circuit relative to refrigerant flow through the cooling circuit and disposed directly downstream of both the condenser and the first coil in the reheat circuit relative to refrigerant flow through the reheat circuit.

17. A heating, ventilation, and/or air conditioning (HVAC) system, comprising:

a refrigerant circuit including a compressor, a condenser, an expansion device, a liquid receiver, a plurality of valves, and a heat exchanger, wherein the heat exchanger includes a first coil and a second coil packaged together in a common heat exchanger slab, wherein the first coil and the second coil are fluidly separate from one another, and wherein the plurality of valves comprises:

a first valve disposed along the refrigerant circuit downstream of the expansion device and upstream of the first coil relative to a first direction of refrigerant flow through the first valve;

a second valve disposed along the refrigerant circuit downstream of the first coil and upstream of the compressor relative to a second direction of refrigerant flow through the second valve;

a third valve disposed along the refrigerant circuit downstream of the compressor and upstream of the first coil relative to a third direction of refrigerant flow through the third valve; and a fourth valve disposed along the refrigerant circuit downstream of the first coil and upstream of the liquid receiver relative to a fourth direction of refrigerant flow through the fourth valve; and a control system configured to adjust a respective position of each valve of the plurality of valves to:

direct refrigerant from the expansion device to the first coil and from the expansion device to the second coil in a cooling mode of the HVAC system; and direct refrigerant from the compressor to the first coil and from the expansion device to the second coil in a reheat mode of the HVAC system.

18. The HVAC system of claim 17, wherein the third valve is a modulating valve, and wherein the control system is configured to:

control the position of the modulating valve to block refrigerant flow therethrough in the cooling mode of the HVAC system;

and control the position of the modulating valve to direct a first portion of refrigerant flow from the compressor to the first coil and a second portion of refrigerant flow from the compressor to the condenser in the reheat mode of the HVAC system.

19. The HVAC system of claim 17, wherein the heat exchanger includes a first distributer configured to route refrigerant to the first coil and a second distributer configured to route refrigerant to the second coil.

20. The HVAC system of claim 17, wherein the common heat exchanger slab includes a first end plate, a second end plate, and a plurality of heat exchanger fins coupled to the first end plate and the second end plate, and wherein the first coil and the second coil are disposed through the plurality of heat exchanger fins.

21. The HVAC system of claim 17, comprising a blower configured to force air sequentially across the second coil and the first coil of the heat exchanger.

22. A heating, ventilation, and/or air conditioning (HVAC) system, comprising:

a heat exchanger slab with a first coil and a second coil coupled to common end plates of the heat exchanger slab, wherein the first coil and the second coil are fluidly separate from one another;

a flow control system configured to operate the HVAC system in a cooling mode and in a reheat mode, wherein the flow control system is configured to flow refrigerant from an expansion device directly to both the first coil and the second coil in the cooling mode, and is configured to flow refrigerant from a compressor directly to the first coil and from the expansion device directly to the second coil in the reheat mode; and a refrigerant circuit comprising the compressor, a condenser, the expansion device, the heat exchanger slab, a liquid receiver, and a plurality of valves, wherein the flow control system is configured to adjust a respective position of each valve of the plurality of valves to switch between the cooling mode and the reheat mode, and wherein the plurality of valves comprises:

a first valve disposed along the refrigerant circuit downstream of the expansion device and upstream of the first coil relative to a first direction of refrigerant flow through the first valve;

a second valve disposed along the refrigerant circuit downstream of the first coil and upstream of the compressor relative to a second direction of refrigerant flow through the second valve;

a third valve disposed along the refrigerant circuit downstream of the compressor and upstream of the first coil relative to a third direction of refrigerant flow through the third valve; and a fourth valve disposed along the refrigerant circuit downstream of the first coil and upstream of the liquid receiver relative to a fourth direction of refrigerant flow through the fourth valve.

23. The HVAC system of claim 22, wherein the flow control system is configured to open the first valve and open the second valve in the cooling mode.

24. The HVAC system of claim 23, wherein the flow control system is configured to close the first valve and close the second valve in the reheat mode.

25. The HVAC system of claim 22, wherein the flow control system is configured to close the third valve and close the fourth valve in the cooling mode.

26. The HVAC system of claim 25, wherein the flow control system is configured to partially open the third valve and fully open the fourth valve in the reheat mode.

* * * * *